US009487942B2

(12) United States Patent
Guo et al.

(10) Patent No.: US 9,487,942 B2
(45) Date of Patent: Nov. 8, 2016

(54) SPRAY SIPHON TOILET WITH ACCELERATING SIPHON

(71) Applicant: Feiyu Li, Xiamen, Fujian (CN)

(72) Inventors: Jieshan Guo, Xiamen (CN); Haitao Xu, Xiamen (CN)

(73) Assignee: XIAMEN AXENT CORPORATION LIMITED, Xiamen (CN)

( * ) Notice: Subject to any disclaimer, the term of this patent is extended or adjusted under 35 U.S.C. 154(b) by 0 days.

(21) Appl. No.: 14/650,101

(22) PCT Filed: Sep. 11, 2013

(86) PCT No.: PCT/CN2013/083339

§ 371 (c)(1),
(2) Date: Jun. 5, 2015

(87) PCT Pub. No.: WO2014/086181

PCT Pub. Date: Dec. 6, 2014

(65) Prior Publication Data

US 2015/0345124 A1 Dec. 3, 2015

(30) Foreign Application Priority Data

Dec. 5, 2012 (CN) ..... 2012 1 0516868
Dec. 5, 2012 (CN) ..... 2012 2 0663926

(51) Int. Cl.

| | |
|---|---|
| ***E03D 11/02*** | (2006.01) |
| ***E03D 11/08*** | (2006.01) |
| ***E03D 1/38*** | (2006.01) |
| ***E03D 1/28*** | (2006.01) |
| ***E03D 11/13*** | (2006.01) |

(52) U.S. Cl.
CPC ..... *E03D 11/08* (2013.01); *E03D 1/286* (2013.01); *E03D 1/38* (2013.01); *E03D 11/13* (2013.01); *E03D 2201/30* (2013.01); *E03D 2201/40* (2013.01)

(58) Field of Classification Search
CPC ..... E03D 2201/30
USPC ..... 4/300–442
See application file for complete search history.

(56) References Cited

FOREIGN PATENT DOCUMENTS

| | | | |
|---|---|---|---|
| CN | 2380623 | Y | 5/2000 |
| CN | 201933595 | U | 8/2011 |
| CN | 202202379 | U | 4/2012 |
| CN | 102587473 | A | 7/2012 |
| CN | 102776947 | A | 11/2012 |
| CN | 202925651 | U | 5/2013 |
| JP | 2763610 | B2 | 6/1998 |
| JP | 2002088881 | A | 3/2002 |

*Primary Examiner* — Lori Baker
(74) *Attorney, Agent, or Firm* — Rabin & Berdo, P.C.

(57) ABSTRACT

A spray type siphon toilet with accelerating siphon includes a toilet body and a first water tank, the top of the urinal of the toilet body is disposed with a flushing hole, the bottom of the urinal of the toilet body is disposed with a spray hole, the toilet body further comprises a flushing waterway to the flushing hole and an spray waterway to the spray hole; the first water tank is disposed with a first drain valve, the inlet of the spray waterway is connected to the drain port of the first drain valve; wherein the spray waterway is connected to a water seal structure, air cannot enter the spray waterway after the first drain valve drains; the water seal surface is even with the water seal surface of the urinal of the toilet body.

11 Claims, 5 Drawing Sheets

SPRAY SIPHON TOILET WITH ACCELERATING SIPHON

FILED OF THE INVENTION

The present invention relates to a siphon toilet, especially to an spray siphon toilet with accelerating siphon.

BACKGROUND OF THE INVENTION

A siphon toilet is a new type toilet that is better than the traditional direct water type flushing toilet, the siphon toilet is disposed with a complete siphon pipe of S shape on the side, the urinal wall has gentle slope, comparing to the direct water type flushing toilet, it improves the noise problem and it also has strong washing-out performance and large flushing surface. There are three types of siphon toilets in existing market: one type is common siphon toilet, a second type is spray siphon toilet and a third type is vortex siphon toilet. Therein, spray siphon type toilet is added with a spray subsidiary pipe and a spray hole at the bottom of the urinal of the toilet comparing to the common siphon toilet, the spray hole directly faces to the washing-out hole of the toilet; when water drains out, a part of water flushes out of the flushing holes arranged at the periphery of the top portion of the urinal of the toilet to wash the inner wall of the urinal of the toilet body, the other part of water sprays out of the spray hole at the bottom of the urinal to wash the bottom of the urinal of the toilet, it also forms siphon effect with the siphon pipe. Significantly, the spray siphon toilet has a larger flushing impact based on the siphon function to wash out the dirt fast, so that this type of siphon toilet has stronger washing-out function.

However, existing spray type siphon toilet is provided that the water diversion position of the flushing holes and the spray hole is disposed above the water seal surface of the urinal of the toilet (the water diversion position is usually disposed at the rear side of the top portion of the urinal of the toilet), as the flushing holes at the top portion of the urinal are connected to the outside air, under the work of the atmosphere pressure, only the pipe below the water seal surface of the urinal keeps water, but the pipe between the water seal surface of the urinal and the drain valve of the toilet is full of air, therefore, after the drain valve of the toilet drains, water firstly fills the pipe between the water seal surface of the urinal and the drain valve of the toilet. during initial period, when water is filling to the pipe of the toilet, part of water flows out of the siphon pipe of the toilet, it makes that the actual flushing potential energy is lower than the initial potential energy, so that the siphon pipe can not immediately form siphon, thus resulting in water wasting. In addition, after the drain valve of the toilet starts to drain, water firstly fills the pipe between the water seal surface of the urinal and the drain valve of the toilet, then flowing out of the flushing holes at the top portion of the urinal, it also results in bad flushing performance to the inner wall of the urinal. Especially to a toilet with lower water tank, the influence is significant.

SUMMARY OF THE INVENTION

The object of the present invention is to overcome the disadvantages of the existing known technology and to provide a spray type siphon toilet with accelerating siphon that can shorten the time of filling the toilet pipe with water extremely, so that the toilet can perform siphon quickly, and it can also provide full amount of flushing water to the flushing hole at the top portion of the urinal, the present invention has well washing-out and water-saving effect.

The technical proposal of the present invention to solve the technical problem is that:

A spray type siphon toilet with accelerating siphon, comprising a toilet body and a first water tank, the top of the urinal of the toilet body is disposed with a flushing hole, the bottom of the urinal of the toilet body is disposed with a spray hole, the toilet body further comprises a flushing waterway to the flushing hole and an spray waterway to the spray hole; the first water tank is disposed with a first drain valve, the inlet of the spray waterway is connected to the drain port of the first drain valve; wherein the spray waterway is connected to a water seal structure, air can not enter the spray waterway after the first drain valve drains; the water seal surface is even with the water seal surface of the urinal of the toilet body.

The water seal structure is U shaped, and the water seal structure is disposed at the bottom portion of a connecting pipe, the part of the connecting pipe according to the top portion of the water seal structure is disposed with an outlet hole, the inlet of the flushing waterway is connected to the outlet hole of the connecting pipe.

The first tank is further disposed with an overflow pipe, the overflow pipe is connected to the flushing waterway.

The water seal structure is U shaped, the water seal structure is disposed at the bottom portion of an overflow pipe of the first tank; the first water tank is further disposed with a second drain valve, the inlet of the flushing waterway is connected to the drain port of the second drain valve.

The water seal structure is U shaped, the water seal structure is disposed at the bottom portion of an overflow pipe of the first tank; the toilet further comprises a second water tank, the water tank is disposed with a second drain valve, the inlet of the flushing waterway is connected to the drain port of the second drain valve.

The water seal structure is U shaped, the water seal structure is disposed at the bottom portion of an overflow pipe of the first water tank; the toilet further comprises a control valve, the inlet of the flushing waterway is connected to water source by the control valve.

The top end of the connecting pipe is integrally connected to the lower end of the overflow pipe.

The connecting pipe and the overflow pipe are independently configured.

The first drain valve and the second drain valve are linked and controlled by a linkage mechanism.

The first drain valve and the control valve are linked and controlled by a linkage mechanism.

In the present invention, when it drains at the first time, water of the first water tank squeezes the air of the spray waterway and then sprays out of the spray hole, so that the siphon pipe forms siphon. With the water seal structure, air of the flushing waterway can not enter the spray waterway after the first drain valve finishes draining. So that after the first drain valve finishes draining, under the work of the atmosphere pressure, the water seal surface of the water seal structure is assigned with the water seal surface of the urinal of the toilet body, so that the spray waterway is full of water or nearly fulfilled. Therefore, when the toilet starts draining next time, water of the first waterway doesn't need to refill the spray waterway, the first drain valve drains to flush and it helps the forming of siphon, so that the siphon starts earlier than the existing technique, the siphon works longer than the existing technique, it not only improves the siphon effect, but also saves water.

Comparing to the exiting spray type siphon toilet, the present invention has advantages that: as the spray water is connected to a water seal structure, air of the flushing waterway can not enter the spray waterway after the first drain valve finishes draining; the water seal surface of the water seal structure is assigned with the water seal surface of the urinal of the toilet body, so that the spray waterway is full of water or nearly fulfilled, when next time the flushing starts, water draining out of the first water tank doesn't need to refill the spray waterway, so that the spray hole of the toilet body can spray water immediately, siphon happens quickly. In addition, the water diversion volume of the flushing holes of the toilet body is increased, flushing starts easier. Therefore, comparing to the existing technique, in same water condition, the siphon and flushing performs for a longer time, the wash-out effect is better; in a condition of less water, the present invention can guarantee flushing function to save water.

The present invention will be further described with the drawings and the embodiments; but it has to be noted that, the scope of the present invention is not limited to the embodiments.

DETAILED DESCRIPTION OF THE EMBODIMENTS

The First Embodiment

Figure 1:
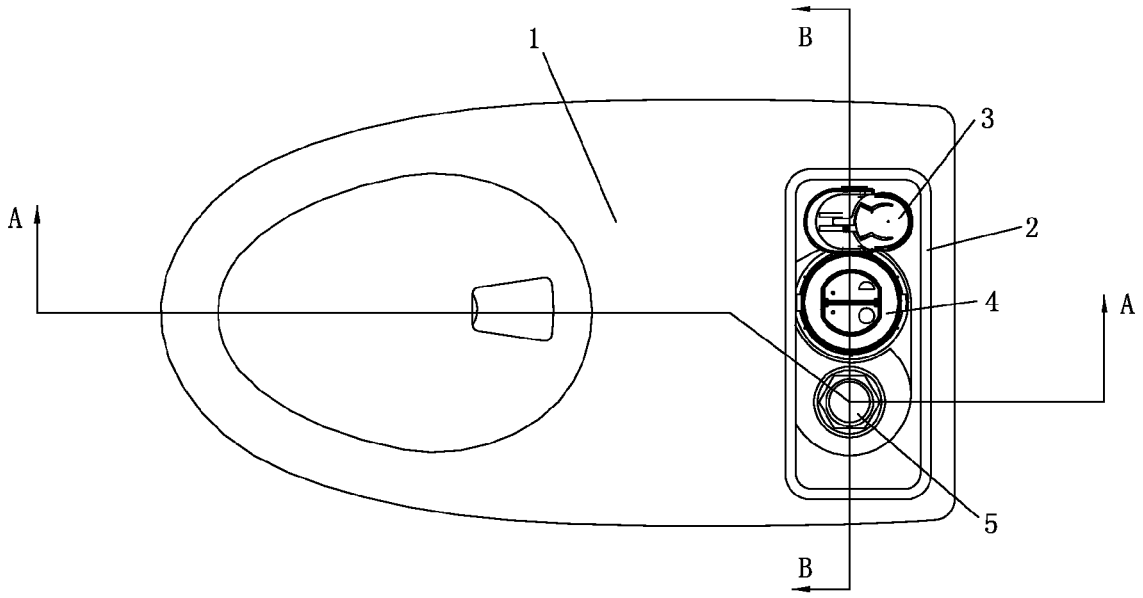
FIG. 1 illustrates a top view of a first embodiment of the present invention.
Figure 2:
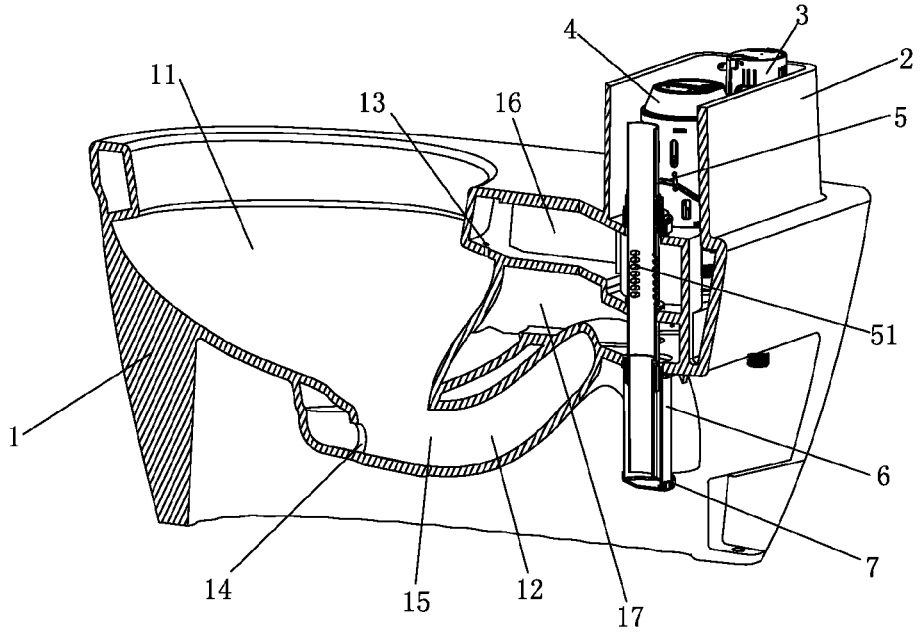
FIG. 2 illustrates a sectional view of the first embodiment in A-A of FIG. 1.
Figure 3:
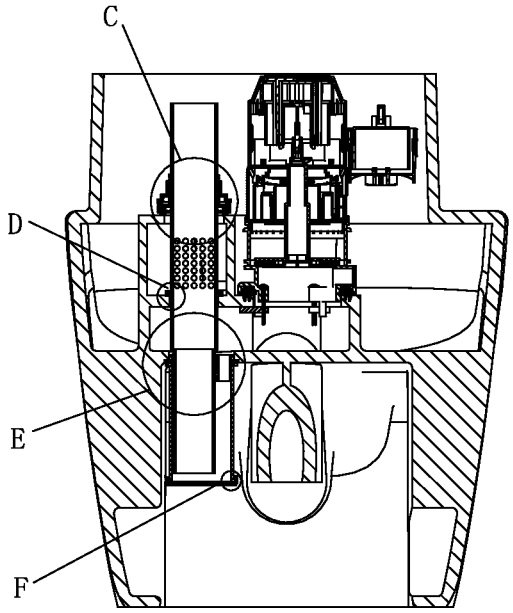
FIG. 3 illustrates a sectional view of the first embodiment in B-B of FIG. 1.
Figure 4:
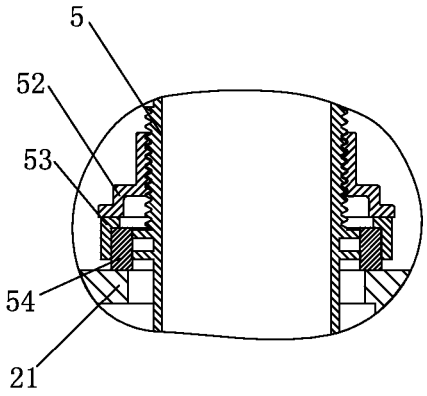
FIG. 4 illustrates an enlargement diagram of C of FIG. 3.
Figure 5:
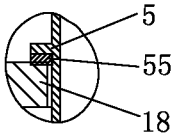
FIG. 5 illustrates an enlargement diagram of D of FIG. 3.
Figure 6:
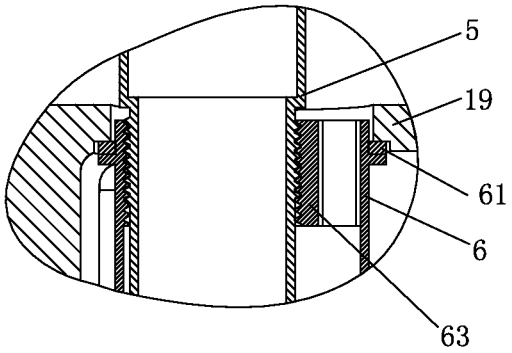
FIG. 6 illustrates an enlargement diagram of E of FIG. 3.
Figure 7:
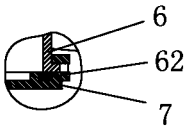
FIG. 7 illustrates an enlargement diagram of F of FIG. 3.

Referring to FIGS. 1-7, a spray type siphon toilet with accelerating siphon of the present invention comprises a toilet body 1 and a first water tank 2, the first water tank 2 and the toilet body 1 are integrally formed, the first water tank 2 is disposed with an inlet valve 3, a first drain valve 4 and an overflow pipe 5, the inlet valve 3 is connected to a water supply system, the top end of the overflow pipe 5 is open and is placed inside the first water tank, the top end of the overflow pipe 5 is higher than the work water level of the first water tank 2; the toilet body 1 is disposed with a urinal 11 and a siphon pipe 12, the periphery of the top portion of the urinal 11 of the toilet body 1 is arranged with a plurality of flushing holes 13, the bottom portion of the urinal of the toilet body 1 is disposed with a spray hole 14, the spray hole 14 is faced to the entrance 15 of the siphon pipe 12, the other end of the siphon pipe 12 is a washing-out hole (not figured out) to connect to the sewer line. The toilet body 1 is further disposed with a flushing waterway 16 connected to the flushing holes 13 and a spraying waterway 17 connected to the spray hole 14, the top entrance of the spray waterway 17 is connected to the drain hole of the first drain valve 4. the spray waterway 17 is further connected a water seal structure, so that air in the flushing waterway 16 would not enter the spray waterway 17 after the first drain valve 4 drains; the water seal surface is even with the water seal surface of the urinal 11 of the toilet body 1.

The water seal structure is U shaped and is disposed to a bottom portion of a connecting pipe, the side wall of the connecting pipe corresponding to the top portion of the water seal structure is disposed with a plurality of outlet holes, the entrance of the flushing waterway 16 is connected to the outlet holes 51 of the connecting pipe. Preferred, the top end of the connecting pipe is integrally connected to the bottom end of the overflow pipe 5, that is to say, the connecting pipe is the overflow pipe 5, the outlet holes of the connecting pipe are disposed in the central side wall of the overflow pipe 5.

In detailed, the bottom end of the overflow pipe 5 runs through out of the first water tank 2 (as figured in FIG. 4, the side wall of the upper section of the overflow pipe 5 is threaded with external thread, and is connected to the ceramic bottom wall 21 of the first water tank in sealing way by a first sealing pad 54, and a sleeve ring 53 of the sealing pad is used to limit the position of the first sealing pad 54, the sleeve ring 53 is pressure by a lock screw 52) and extends to the toilet body 1, the bottom end of the overflow pipe 5 is opening and is connected to the spray waterway 17, the bottom end of the inner side of the overflow pipe 5 is below the water seal surface of the urinal of the toilet body.

The bottom end of the overflow pipe 5 runs through out of the ceramic bottom wall 21 of the first water tank, then runs through the flushing waterway 16 (as figured in FIG. 5, a second sealing pad is disposed between the overflow pipe 5 and the lower pipe wall 18 of the flushing waterway), finally enters the spray waterway 17. in detailed, the pipe wall of the spray waterway 17 is disposed with an upper hole and a lower hole for the overflow pipe to run through, the water seal structure at the bottom portion of the overflow pipe 5 is realized by an extension pipe 6 that is connected to the lower hole of the spray waterway 17 in sealing way, the lower end of the extension pipe 6 is closed at the outer side of the spray waterway. As figured in FIG. 2, FIG. 6 and FIG. 7, a third sealing pad 61 is disposed between extension pipe 6 and the lower pipe wall 19 of the spray waterway 17; the lower end of the extension pipe 6 is opening and is plugged by a seal end cover 7, a fourth sealing pad 62 is disposed between the extension pipe and the seal end cover 7 in sealing way. The overflow pipe runs through the upper hole in sealing way, the lower end extends downwardly to the extension pipe 6, but the bottom end of the overflow pipe 5 is not contacted with the bottom surface of the inner side of the extension pipe 6, that is to say, the bottom end of the overflow pipe 5 is higher than the bottom surface of the inner side of the extension pipe 6 (the inner surface of the seal end cover 7); the bottom portion of the overflow pipe 5 is coupled to the extension pipe to form a U shaped water seal structure. Herein, the side wall of the lower section of the overflow pipe 5 is disposed with an external thread, the extension pipe 6 is fixedly disposed with a thread sleeve pipe 63 with an internal thread (as figured in FIG. 6), the internal diameter of the thread sleeve pipe 63 is smaller than the internal diameter of the extension pipe 6; the external thread of the lower section of the overflow pipe 5 is engaged to the internal thread of the thread sleeve pipe 63.

In the present invention, when it drains at the first time, water of the first water tank with higher potential energy flows to the spray hole 14 and the overflow pipe 5 by the spray waterway 17, and air is squeezed out of the spray waterway 17; water flows out of the spray hole 14 and flushes the bottom portion of the urinal of the toilet body, siphon forms in the siphon pipe 12. when the water level of the overflow pipe 5 reaches to the outlet holes 51, a part of the water in the first water tank 2 flows to the flushing waterway 16 by the outlet hole 51 and flushes the inner wall of the urinal of the toilet body 1 by the flushing holes 13. when the first drain valve 3 is closed, as the spray waterway 17 is only connected to the outer side by the spray hole 14 and the overflow pipe 5, the spray hole 14 and the bottom portion of the overflow pipe 5 are in water (the water level of the overflow pipe 5 is aligned with the lower edge of the outlet holes 51), so that the spray waterway 17 is full of water. As the water level of the spray hole 14 is at the lowest position, the water levels at both ends of the spray waterway 17 have a height difference, it forms siphon, water of the connecting pipe is absorbed to the spray hole 14 until the water levels at the both ends of the spray waterway 17 are balanced. During the water fills in, the water seal level of the urinal water restores, water level of the connecting pipe raises at the same time, the water level of the connecting pipe 8 is aligned with the water seal surface of the urinal, air of the flushing waterway 16 can not enter the spray waterway 17. Under the atmosphere pressure, water of the spray waterway 17 wouldn't flow to the two ends at the allowing height of the atmosphere pressure, the spray waterway 17 is full of water or nearly fulfilled.

When it drains at the second time, water of the first water tank flows to the spray hole 14 and the overflow pipe 5 by the spray waterway 17. as the spray waterway 17 has a certain of water volume, the first water tank doesn't need to fill water in. the water flow rate of the spray hole 14 is significantly higher than the spray waterway 17 that is not full of water, so that it is benefit to the siphon pipe 12 of the toilet body to form siphon, thus benefit to save water. In addition, a part of water of the first water tank flows to the flushing waterway 16 by the outlet holes 51 of the overflow pipe, the spray waterway 17 has a certain of water volume, it doesn't need to fill water to the spray waterway 17, so that the toilet body 1 can realize flushing the inner wall of the urinal earlier, the water diversion volume of the flushing holes 13 of the toilet body is increased. When the first drain valve 4 is closed, the spray waterway 17 keeps fulfilled or nearly fulfilled.

Figure 8:
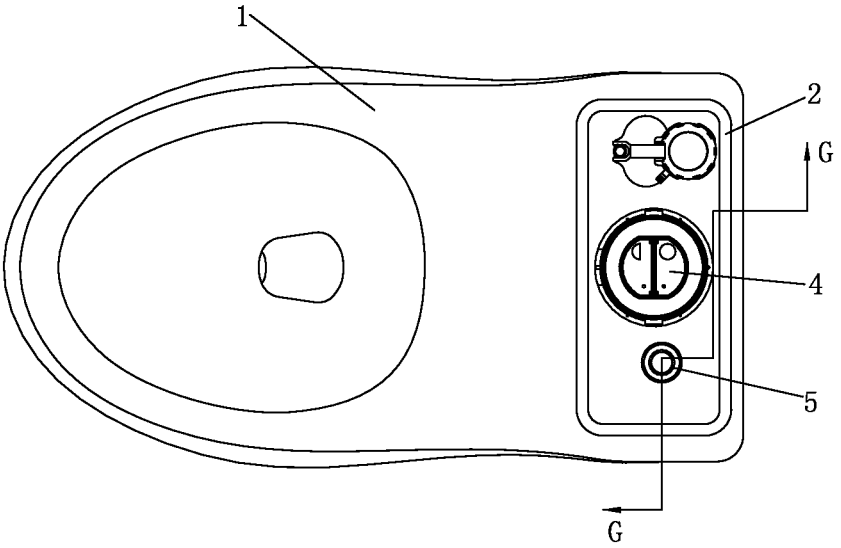
FIG. 8 illustrates a top view of a second embodiment of the present invention.
Figure 9:
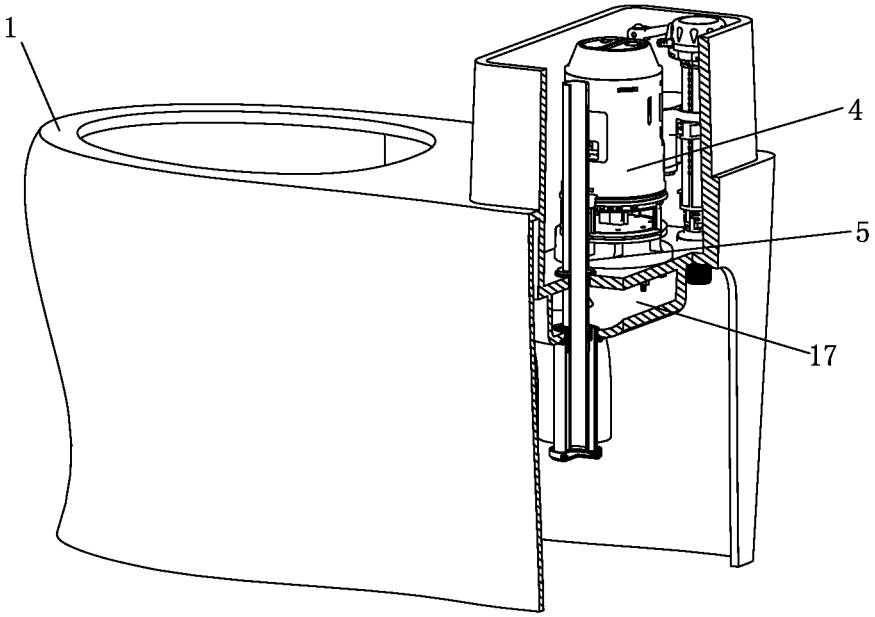
FIG. 9 illustrates a sectional view of the second embodiment in G-G of FIG. 8.

The Second Embodiment:

Referring to FIG. 8 and FIG. 9, a spray type siphon toilet with accelerating siphon of the third embodiment has difference from above mentioned first embodiment that: the flushing waterway is supplied water by a second water tank (not figured out), the second water tank is disposed with a second drain valve, the entrance of the flushing waterway is connected to the drain port of the second drain valve. Herein, the first drain valve 4 is connected to the second drain valve by a linkage mechanism to linkage control the first drain valve 4 and the second drain valve. So that when the first drain valve connected to the spray waterway 17 is open, the second drain valve is open at the same time, or the second drain valve is not open, so that water flows out of the flushing waterway to wash the inner wall of the urinal of the toilet body 1.

Applying with above structure, same as the first embodiment, when it drains at the first time, water of the first water tank 2 flows firstly to the spray waterway 17 and the overflow pipe 5, and air is squeezed out of the spray waterway 17; then with the water flows out of the first water tank, water sprays out of the spray hole to flush the bottom portion of the urinal of the toilet body 1, and siphon forms in the siphon pipe. As the water of the flushing waterway is from the second water tank, the work state of the flushing waterway and the work state of the spray waterway 17 are independent. When the first drain valve 4 is closed, the water level of the overflow pipe 5 is assigned with the water level of the first water tank in close condition, the spray waterway 17 is full of water. As the water level of the spray hole is at the lowest position, the water levels of the both ends of the spray waterway 17 are different in height, so that it forms siphon, water of the overflow pipe 5 is absorbed to the spray hole until the water levels at both ends of the spray waterway 17 are balanced. With water fills to the toilet, the water seal level of the urinal is restored, water level of the overflow pipe 5 is raised at the same time, the water level of the overflow pipe 5 is finally aligned with the water seal surface of the urinal. Under the work of the atmosphere pressure, the spray waterway 17 keeps in fulfilled or nearly fulfilled.

When it drains at the second time, similarly, water of the first water tank doesn't need to fill to the spray waterway 17, water flow rate of the spray hole 14 is significantly higher than the spray waterway 17 that is not full of water, so that it is benefit to the siphon pipe 12 of the toilet body to form siphon, thus benefit to save water. In addition, the toilet tank can realize to flush the inner wall of the urinal earlier, the water volume of the flushing holes of the toilet body 1 is increased.

Figure 10:
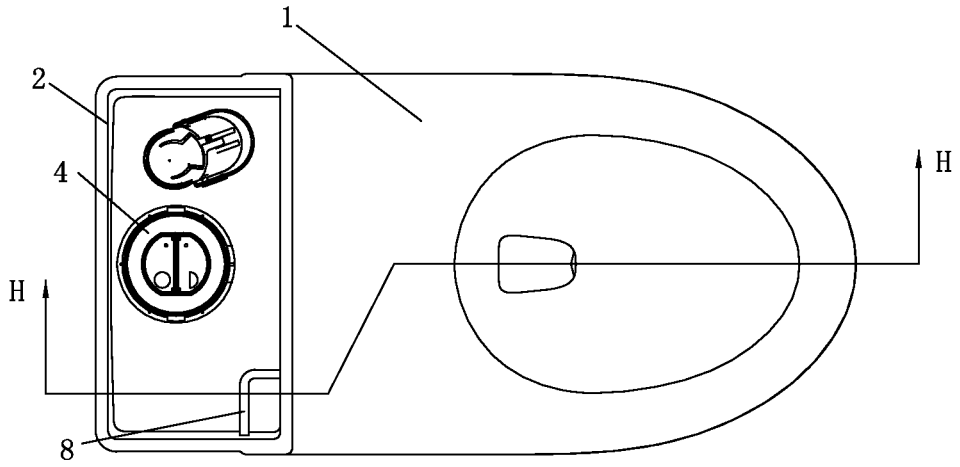
FIG. 10 illustrates a top view of a third embodiment of the present invention.
Figure 11:
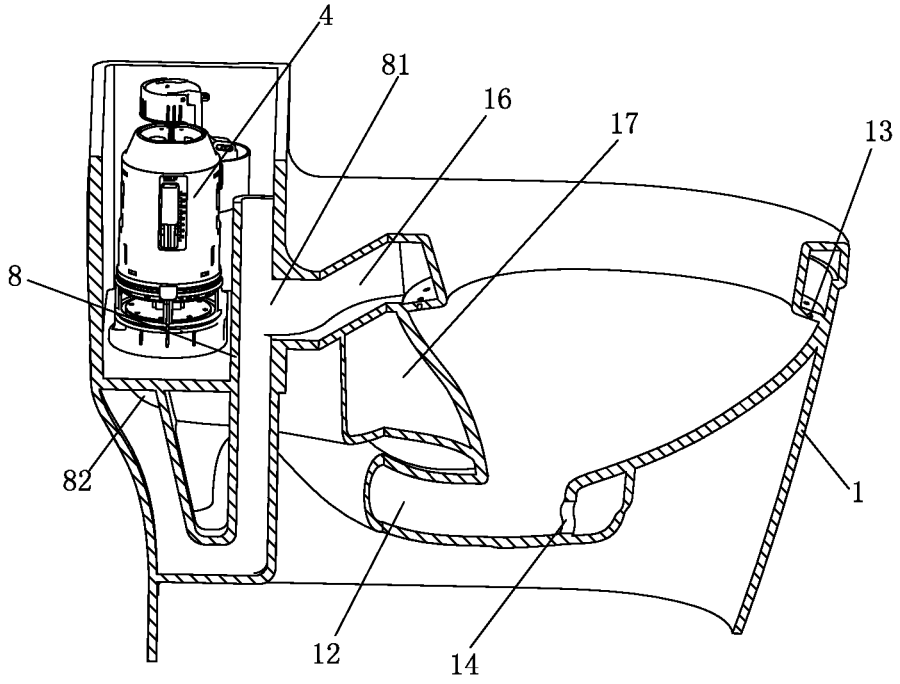
FIG. 11 illustrates a sectional view of the third embodiment in H-H of FIG. 10.

The Third Embodiment:

Referring to FIG. 10 and FIG. 11, a spray type siphon toilet with accelerating siphon of the third embodiment has difference from above mentioned first embodiment that: the connecting pipe 8 is an independent pipe that is integrated with the toilet body, the top end of the connecting pipe 8 is opening, the top end of the connecting pipe 8 is disposed in the first water tank 2, the opening of the top end is higher than the water level of the first water tank 2 (water of the first water tank can overflow out of the opening of the top end of the connecting pipe 8), the bottom end of the connecting pipe 8 is bended upwardly, the bottom portion of the connecting portion 8 is bended to a U shaped structure, thus forming a water seal structure, the top end of the bending portion of the connecting pipe 8 is disposed with a connecting hole 82, the connecting pipe 8 is connected to the spray waterway 17 by the connecting hole 82; the side wall of the central section of the connecting pipe 8 is disposed with an outlet hole 81 (the outlet hole 81 is disposed above the water seal surface of the urinal 11 of the toilet body), the entrance of the flushing waterway 16 is connected to the outlet hole 81 of the connecting pipe 8. if the water tank 2 is disposed with an overflow pipe, the overflow pipe is connected to the flushing waterway 16.

Applying with above structure, when it drains at the first time, water of the first water tank flows to the spray hole 14 and the connecting pipe 8 by the spray waterway 17, and air is squeezed out of the spray waterway 17; water flows out of the spray hole 14 and flushes the bottom portion of the urinal of the toilet body, siphon forms in the siphon pipe 12. during the first drain valve 4 drains, when the water level of the connecting pipe reaches to the outlet hole 81, a part of the water in the first water tank flows to the flushing waterway 16 by the outlet hole 81 and flushes the inner wall of the urinal of the toilet body 1 by the flushing holes 13. when the first drain valve 4 is closed, as the spray waterway 17 is only connected to the outer side by the spray hole 14 and the connecting pipe 8, the spray hole 14 is in water, the water level of the connecting pipe 8 is aligned with the lower edge of the outlet hole 81, so that the spray waterway 17 is full of water. As the water level of the spray hole 14 is at the lowest position, the water levels at both ends of the spray waterway 17 have a height difference, it forms siphon, water of the connecting pipe is absorbed to the spray hole 14 until the water levels at the both ends of the spray waterway 17 are balanced. During the water fills in, the water seal level of the urinal water restores, water level of the connecting pipe raises at the same time, the water level of the connecting pipe 8 is aligned with the water seal surface of the urinal, air of the flushing waterway 16 can not enter the spray waterway 17. Under the atmosphere pressure, the spray waterway 17 is full of water or nearly fulfilled.

When it drains at the second time, similarly, water of the first water tank doesn't need to fill to the spray waterway 17, water flow rate of the spray hole 14 is significantly higher than the spray waterway 17 that is not full of water, so that it is benefit to the siphon pipe 12 of the toilet body to form siphon, thus benefit to save water. In addition, as water of the first water tank doesn't need to fill to the spray waterway 17, the toilet tank can realize to flush the inner wall of the urinal earlier, the water volume of the flushing holes 13 of the toilet body is increased.

The Fourth Embodiment:

A spray type siphon toilet with accelerating siphon of the fourth embodiment has difference from above mentioned embodiments that: the upper pipe wall of the spray waterway is disposed with a hole for the connecting pipe (the connecting pipe can be applied with the overflow pipe), a concave portion is disposed at the lower portion of the lower pipe wall of the spray waterway corresponding to the hole; the bottom end of the connecting pipe is opening, the bottom end of the connecting pipe runs through the hole of the spray waterway in sealing way and inserts downwardly to the concave portion of the spray waterway, the bottom end of the connecting pipe is higher than the bottom surface of the concave portion; so that the concave portion of the spray waterway is served as the extending pipe in the first embodiment, the bottom portion of the concave portion coupled to the connecting pipe is also formed a U shaped water seal structure.

Applying with above structure, when it drains, the drain ports of the first drain valve and the second drain valve are open at the same time, water flows respectively to the spray waterway and the flushing waterway, so as to realize siphon function and flushing function to the urinal wall of the toilet body.

The Fifth Embodiment:

A spray type siphon toilet with accelerating siphon of the fifth embodiment has difference from above mentioned embodiments that: a second drain valve is assembled to the first water tank, the entrance of the flushing waterway is connected to the drain port of the second drain valve. For conveniently controlling, the control valve is connected to the first drain valve of the first water tank by a linkage mechanism, so as to realizing linkage controlling.

Applying with above structure, when it drains, the drain ports of the first drain valve and the second drain valve are open at the same time, water flows respectively to the spray waterway and the flushing waterway, so as to realize siphon function and flushing function to the urinal wall of the toilet body.

Applying with the fifth embodiment, every time it drains, the spray waterway is full of water or nearly fulfilled, so that it can not only immediately form siphon to save water, but also can flush the urinal wall of the toilet body earlier.

The Sixth Embodiment:

A spray type siphon toilet with accelerating siphon of the sixth embodiment has difference from above mentioned embodiments that: the flushing waterway is supplied water by the tap water, it further comprises a control valve, the entrance of the flushing waterway is connected to the tap water by the control valve. For conveniently controlling, the control valve is connected to the first drain valve of the first water tank by a linkage mechanism, so as to realizing linkage controlling. Applying with above structure, when the first drain valve and the control valve are open at the same time, water of the first water tank flows to the spray waterway, so that the water flows to the flushing waterway, thus realizing siphon function and flushing function to the urinal wall of the toilet body; after the draining, the first drain valve and the control valve are closed at the same time.

Applying with the sixth embodiment, every time it drains, the spray waterway is full of water or nearly fulfilled, so that it can not only immediately form siphon to save water, but also can flush the urinal wall of the toilet body earlier.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

The invention claimed is:

1. A spray type siphon toilet with accelerating siphon, comprising a toilet body and a first water tank, the top of the urinal of the toilet body is disposed with a flushing hole, the bottom of the urinal of the toilet body is disposed with a spray hole, the toilet body further comprises a flushing waterway to the flushing hole and an spray waterway to the spray hole; the first water tank is disposed with a first drain valve, the inlet of the spray waterway is connected to the drain port of the first drain valve; wherein the spray waterway is connected to a water seal structure, air can not enter the spray waterway after the first drain valve drains ; the water seal surface is even with the water seal surface of the urinal of the toilet body.

2. The spray siphon toilet with accelerating siphon according to claim 1, wherein the water seal structure is U shaped, and the water seal structure is disposed at the bottom portion of a connecting pipe, the part of the connecting pipe according to the top portion of the water seal structure is disposed with an outlet hole, the inlet of the flushing waterway is connected to the outlet hole of the connecting pipe.

3. The spray siphon toilet with accelerating siphon according to claim 1, wherein the first tank is further disposed with an overflow pipe, the overflow pipe is connected to the flushing waterway.

4. The spray siphon toilet with accelerating siphon according to claim 1, wherein the water seal structure is U shaped, the water seal structure is disposed at the bottom portion of an overflow pipe of the first tank; the first water tank is further disposed with a second drain valve, the inlet of the flushing waterway is connected to the drain port of the second drain valve.

5. The spray siphon toilet with accelerating siphon according to claim 1, wherein the water seal structure is U shaped, the water seal structure is disposed at the bottom portion of an overflow pipe of the first tank; the toilet further comprises a second water tank, the water tank is disposed with a second drain valve, the inlet of the flushing waterway is connected to the drain port of the second drain valve.

6. The spray siphon toilet with accelerating siphon according to Claim 1, wherein the water seal structure is U shaped, the water seal structure is disposed at the bottom portion of an overflow pipe of the first water tank; the toilet further comprises a control valve, the inlet of the flushing waterway is connected to water source by the control valve.

7. The spray siphon toilet with accelerating siphon according to claim 3, wherein the top end of the connecting pipe is integrally connected to the lower end of the overflow pipe.

8. The spray siphon toilet with accelerating siphon according to claim 3, wherein the connecting pipe and the overflow pipe are independently configured.

9. The spray siphon toilet with accelerating siphon according to claim 4, wherein the first drain valve and the second drain valve are linked and controlled by a linkage mechanism.

10. The spray siphon toilet with accelerating siphon according to claim 6, wherein the first drain valve and the control valve are linked and controlled by a linkage mechanism.

11. The spray siphon toilet with accelerating siphon according to claim 5, wherein the first drain value and the second drain value are linked and controlled by a linkage mechanism.

* * * * *